United States Patent [19]

Coles

[11] 4,202,152

[45] May 13, 1980

[54] WRAPPING PROCESS

[75] Inventor: Robert E. Coles, Leamington Spa, England

[73] Assignee: General Foods Limited, Banbury, England

[21] Appl. No.: 923,112

[22] Filed: Jul. 10, 1978

Related U.S. Application Data

[63] Continuation-in-part of Ser. No. 795,355, May 9, 1977, abandoned.

[51] Int. Cl.[2] ..... B65B 9/12

[52] U.S. Cl. ..... 53/451; 53/551

[58] Field of Search ..... 53/451, 551, 554, 576, 53/577, 567, 212, 442; 206/499, 519; 221/307

[56] References Cited

U.S. PATENT DOCUMENTS

| | | | |
|---|---|---|---|
| 2,635,402 | 4/1953 | Jorgensen | 53/212 |
| 2,641,095 | 6/1953 | Burbank | 53/550 |
| 2,804,236 | 8/1957 | Piazze | 221/307 X |
| 2,847,806 | 8/1958 | Wang | 53/567 |
| 3,240,331 | 3/1966 | Weinstein | 206/499 |
| 3,289,385 | 12/1966 | Siverson et al. | 53/442 X |
| 3,524,296 | 8/1970 | Piazze | 53/442 X |
| 3,775,940 | 12/1973 | Hatanaka | 53/212 |

FOREIGN PATENT DOCUMENTS

| | | | |
|---|---|---|---|
| 641862 | 7/1962 | Italy | 53/567 |

*Primary Examiner*—John Sipos

*Attorney, Agent, or Firm*—Robert Edward Coles

[57] ABSTRACT

Process for wrapping a stack of dispensing cups, each cup containing a measured amount of material, to provide a package for assuring extended storage life for the material therein.

5 Claims, 8 Drawing Figures

12
B
10
10'
11
15
A
8
18
18'
16'
17
16
9'
9
8
7
3
2
6
5
3
6'
1
3
4
15
13
14

12
20
8
17
3
8
2
3
7
1
5
4

WRAPPING PROCESS

This application is a continuation-in-part of Ser. No. 795,355 filed May 9, 1977 now abandoned.

BACKGROUND OF THE INVENTION

It is known to pack hygroscopic or deliquescent materials in granule or powder form, for example coffee, in cups intended for use in machines for dispensing liquids. Such materials are dissolved in water to form the liquid being dispensed, and, on storage prior to the addition of the liquid, tend to attract and absorb moisture. Accordingly, it is desirable to protect stacks of cups intended for use in dispensing machines of the type described from exposure to moisture during storage. United Kingdom Pat. No. 1,062,436 describes and claims a package of nested cups for use in a dispensing machine, each cup containing a measured quantity of dehydrated material, for example instant coffee powder, wherein the desired protection comprises a bag of moisture impervious material enclosing the stack of cups and shrunken into engagement radially with said cups and axially against the ends of the said stack.

In the package disclosed in U.S. Pat. No. 1,062,436 the bag is made of a plastics material of the type which shrinks when subjected to heat and retains its shrunken condition when the heat is removed. An example of a suitable plastics material is transparent plastic film sold under the registered trade mark "Cryovac". The bag used to produce the said package is a hollow tube of plastics material closed at one end having its other end open to receive the stack of nested cups and subsequently sealed by twisting the material and holding it with a clamping device after the stack is inserted. After sealing, the bag is shrunken by immersion in hot water, thus providing an endwise pressure which maintains the cups in an interlocking position and provides a useful seal. Although the package described in U.S. Pat. No. 1,062,436 is a vast improvement over previous packages, the shrinking does result in moisture remaining in the twisted film above the metallic sealing clip referred to. Micro-leakage of this moisture, for example by capillary action, into the package can occur through the clip seal. This reduces the storage life of the powder. There is also a certain amount of wastage of plastics material resulting from the twisting and clamping of the material to seal one stack in that up to one quarter of the initial bag length is required to be cut-off and discarded. A further disadvantage of the shrinking process is that some distortion of the cups can occur, thus making automatic cup dispensing difficult.

It has been found that these disadvantages may be avoided and a sealed package having an improved storage life for the beverage ingredients contained therein may be provided by forming a wrapping as hereinafter described.

The present invention provides an alternative process to that described in U.S. Pat. No. 1,062,436 and is a vertical form, load and seal technique using flexible packaging films or film laminates. It gives packages having an improved shelf-life over packs described in U.S. Pat. No. 1,062,436 when appropriate materials are selected, together with a saving in material and labour costs and an improved print design is available, and does not involve the use of vacuum packaging.

SUMMARY OF THE INVENTION

According to the present invention there is provided a continuous process for forming a package of a stack of nesting cups, each cup of which contains one or more ingredients for a beverage, which process comprises forming a tube from a moving sheet of wrapping material, heat-sealing the leading end of said tube, loading vertically upwards a stack of nesting cups, each cup containing one or more ingredients for a beverage, into the open end of said tube by means of a ram or like lifting device, flattening the edges of said tube, heat-sealing the flattened edges to secure the stack of cups within the tube and to provide the tube with a remaining open portion, removing the ram or like lifting device from the tube through the remaining open portion thereof, and thereafter heat-sealing said tube to form a hermetically sealed package.

In a preferred embodiment the loading of the stack of cups is such that the top cup in the stack reaches the extreme of the tube, and the flattening of the edges of the open end of the tube tightens stack.

When the cups are non-interlocking cups the stack must be further tightened, after the tube has been heat-sealed, to prevent seepage of the ingredients from the cups.

The seals at the top and bottom of the tube are fin-seals. The weight of the product will tend to make the bottom seal bend and stay flat, especially if the pack is side-gussetted when the pack is upright. Likewise, to achieve a tight top to bottom pressure, the fin-seals at the top are folded flat and to achieve this, a hot melt adhesive or other suitable contact adhesive is applied to a top fin. This fin is then folded over quickly and the edges of the seal are further folded downwards against the side of the tube. In addition to producing a tight cupstack this enables print copy to be visible over the mouth of the cupstack, which is of value when the stack is displayed on its side and only an end-on view of the cupstack is visible.

The tube is preferably formed from a continuous single roll of material which is heat-sealed around a hollow rigid metal or plastic tube. The leading end of the material is flattened and sealed at right-angles to the lengthwise seal by which the tube was formed. If a gusset is required, the edges of the film tube are folded inwards to a predetermined amount before the leading edge is sealed. This is achieved by a mechanical protrusion and once in position all subsequent tubes will also be gussetted.

A variety of equipment is available for packaging in a vertical plane. However, to form a package by the process according to the invention, the machines must be loaded and operated in the reverse manner to which they normally package products.

Suitable film or film laminate compositions for use in the process of the present invention, which compositions may be used in any combination with each other, include the following:

Nitrocellulose or PVdC/Cellulose Film/Polyethylene
Bleached Kraft/Aluminum Foil/Polyethylene
PVdC/Polyester Film/Polyethylene
PVdC/Polyamide Film/Polyethylene
Polyamide/Polyethylene
Polyester Film/Polyethylene
Metallized Polyester Film/Polyethylene
PVdC/Polypropylene Film/Polyethylene Polyethylene/Polyamide/Polyethylene It is known that as the thickness of the materials chosen increases, so the life of the product may be expected to increase. Furthermore, for extended life products, higher component laminates may be used if transparency is essential. It is possible to have 3, 4 or more components if desired, although for cost effectiveness the paper/foil/polyethylene example quoted above will offer a long life at optimum expense.

One of the advantages of vertical form-load packs is that printed material such as labels and advertising matter may be included within the wrapping material as with thermoformed vacuum packs. With either form-load pack however, the copy may extend all around the side of the cupstack film wrap and be present on the top and bottom of the pack as well, at no significant additional cost when the film is itself printed.

The present invention also provides a package that will protect the product, once packed and sealed, without having to rely on vacuum retention or on shrinkage of the wrapping material.

It is possible that during warehousing and distribution of packages according to this invention, the top cup and those immediately below it could become distorted. This distortion may be avoided if a cap or plug or semi-rigid plastic or similar formed material is applied to the top cup. A plug is preferred to a snap-on lid, since a lid protrudes and could scuff, and hence damage, the enveloping wrapping material.

BRIEF DESCRIPTION OF THE DRAWINGS

The invention will further be described with reference to the additional Figures in the accompanying drawings in which.

DESCRIPTION OF THE PREFERRED EMBODIMENT

Figure 1:
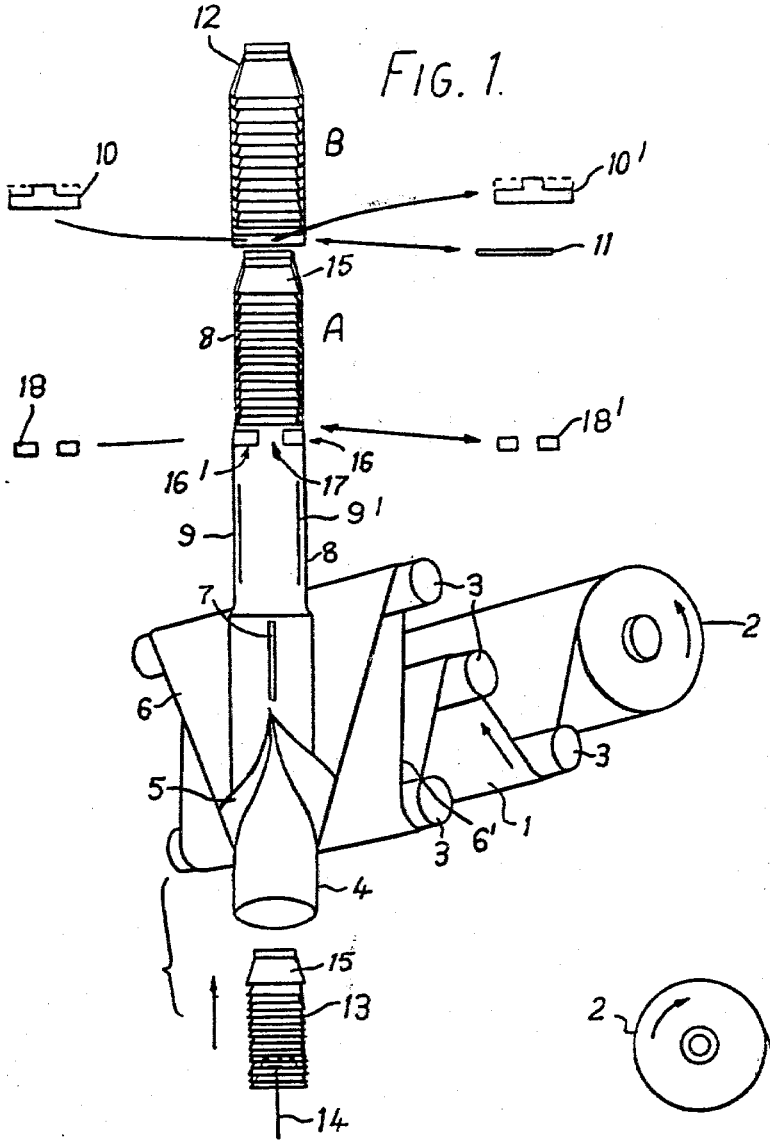
FIG. 1 is a schematic side elevation of a preferred embodiment for performing the vertical form-load process of the invention
Figure 2:
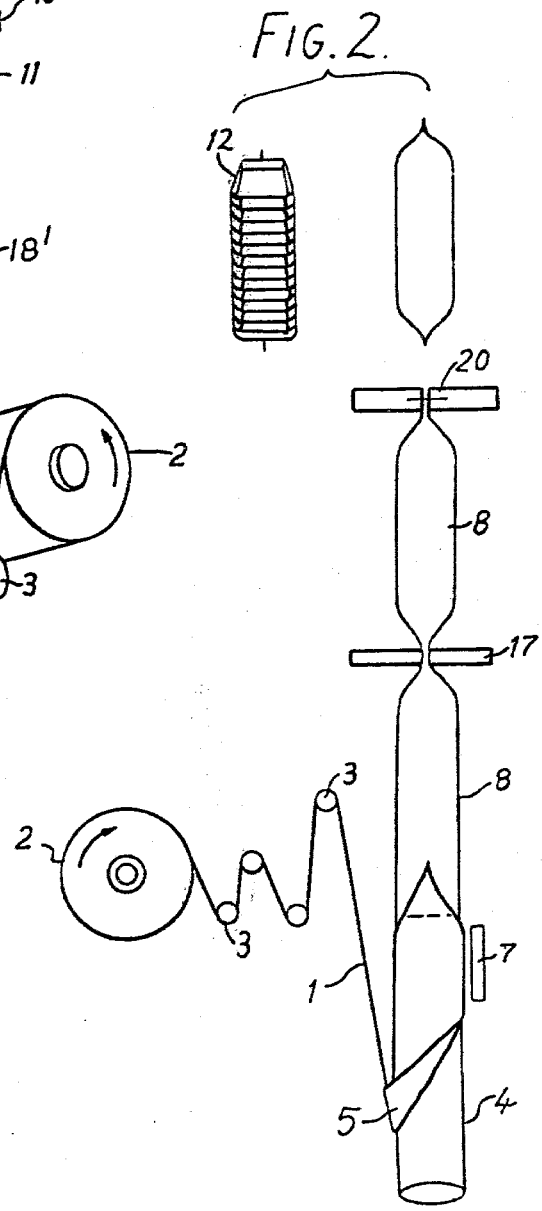
FIG. 2 is a plan view of FIG. 1.

Referring to FIG. 1 of the accompanying drawings, a sheet of film/film laminate 1 is drawn from a feed roll 2 over tensioning rollers 3 and is guided around a former 4 by means of a forming collar 5. Opposite edges 6 and 6' of the laminate 1 are heat-sealed together by the heat from a heat-seal bar 7 to thereby form a tube 8. The edges of the tube 8 are folded inwards to form side gussets 9 and 9' and the tube 8 is moved to position A where the leading end of the tube 8 is fin-sealed by means of a heated crimpt jaw set 10 and 10''. A guillotine 11 separates the tube 8 (now closed at one end) from the alread formed package 12. A cupstack 13 in which all but the lowermost cup contain beverage ingredients is lifted by a ram 14 through the former 4 and into the tube 8 until the top cup 15 (plus plug if desired) of the cupstack 13 reaches the extreme of the closed tube 8. The edges 16 and 16' of the tube 8 are flattened leaving the tube 8 with an open portion 17 and heat-sealed by means of a heated crimp jaw set 18 and 18'', thereby securing the cupstack 13 within the tube 8. The ram 14 is thereafter removed through the open portion 17 and the tube 8 containing the cupstack 13 is moved to position B where the open portion 17 of the tube 8 is heat-sealed by means of heated crimp jaw set 10 and 10' to form the package. The heat-sealing also seals the leading end of the next package to be formed. The guillotine 11 then separates the formed package from the next package to be formed.

Figure 3:
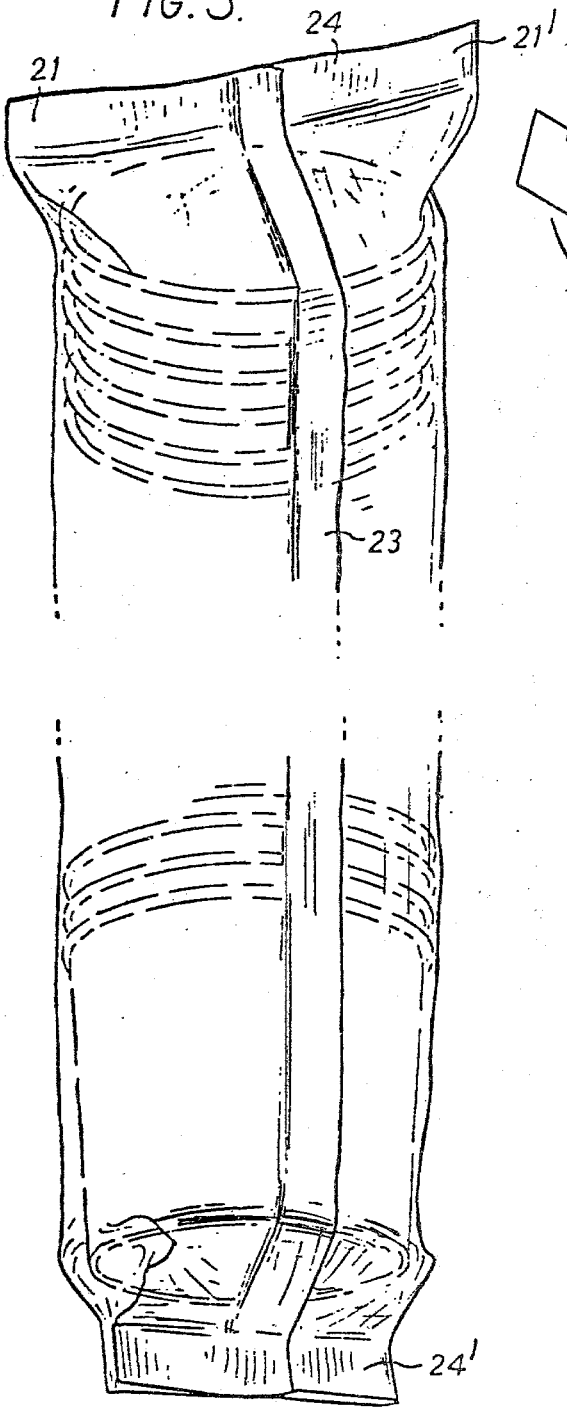
FIGS. 3 and 4 illustrate a typical vertical package according to the invention.
Figure 4:
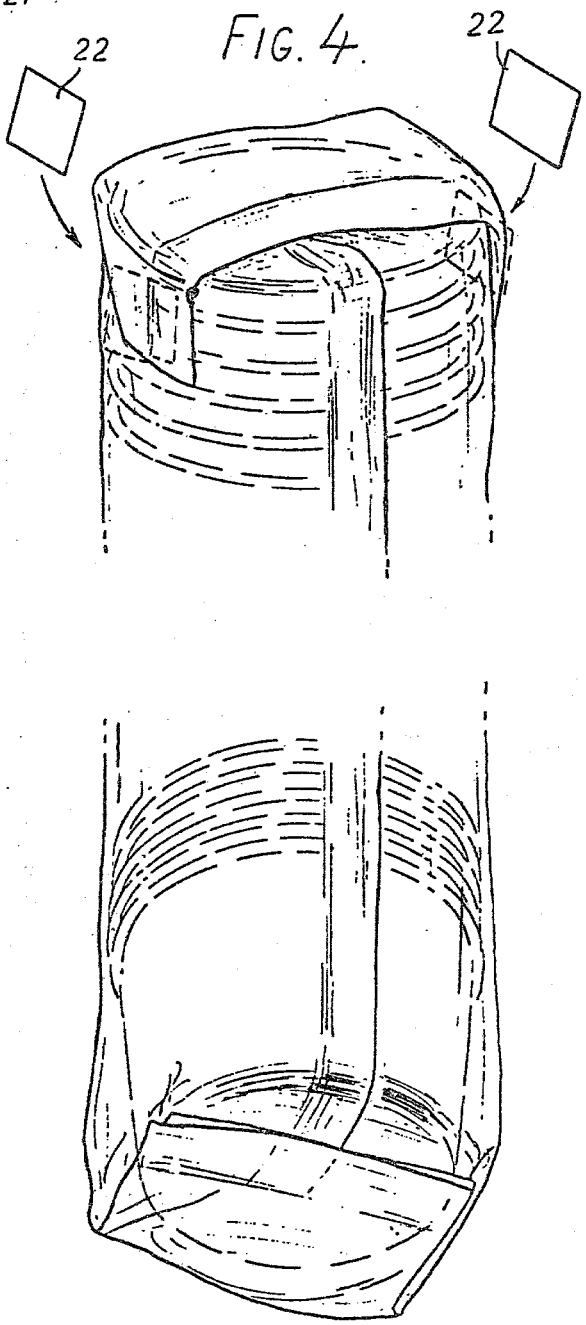

Adhesive is applied to the edges of the top fin-seal at positions 21 and 21' (FIG. 3 ), and the fin-seal is folded over with the bonded edges held in place by spring loaded clamps 22 which release after a short interval to produce the package shown in FIG. 4.

The finished pack shown in FIGS. 3 and 4 comprises a stack of cups enveloped in wrapping material and having a longitudinal heat-seal 23 and transverse crimped fin-seals 24 and 24'.

Figure 5:
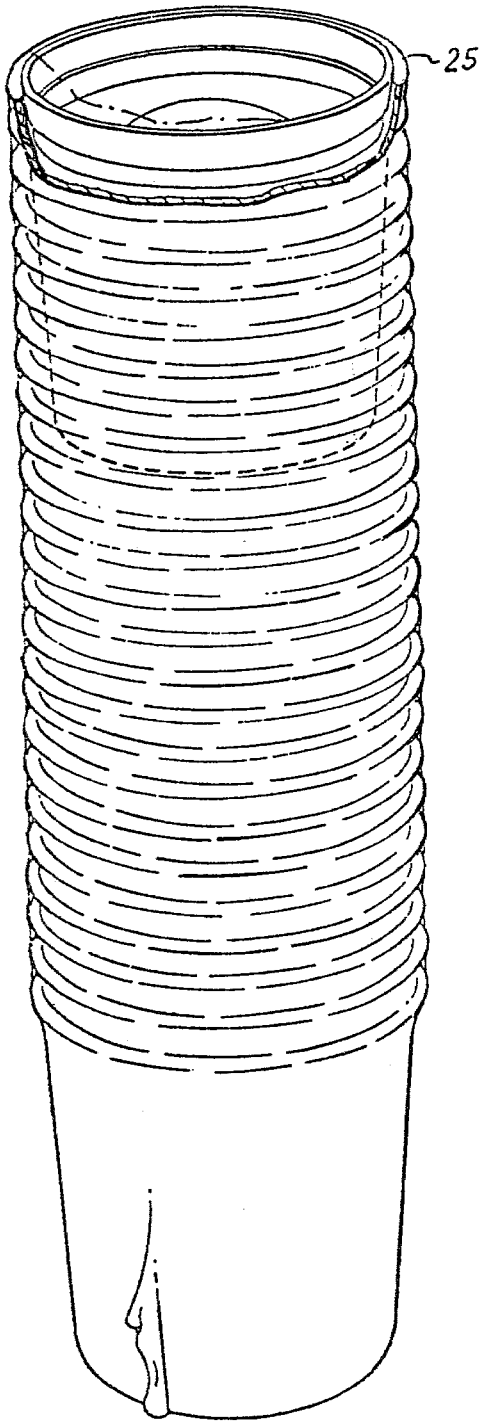
FIG. 5 illustrates the top cup of a stack of cups containing a cup plug to protect the cup from deformation during wrapping.

In FIG. 5 the top cup 25 of a stack is provided with a plug 26 (FIGS. 6 and 7) which prevents possible distortion during warehousing and transit when the pack is made by the process according to the invention. To further prevent the pack from damage, the top edge of each side of the gusset may be sealed to the adjacent sidewalls to produce what has been found to be a package that transports, warehouses and protects hygroscopic beverage products satisfactorily for periods of time not obtained in the prior art.

Figure 6:
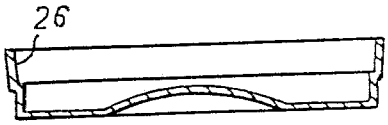
FIGS. 6 and 7 show the preferred shape of a plug in elevation and plan respectively.
Figure 7:
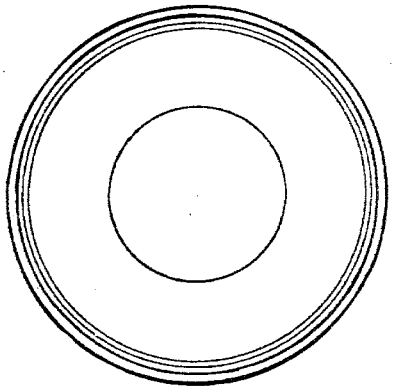
Figure 8:
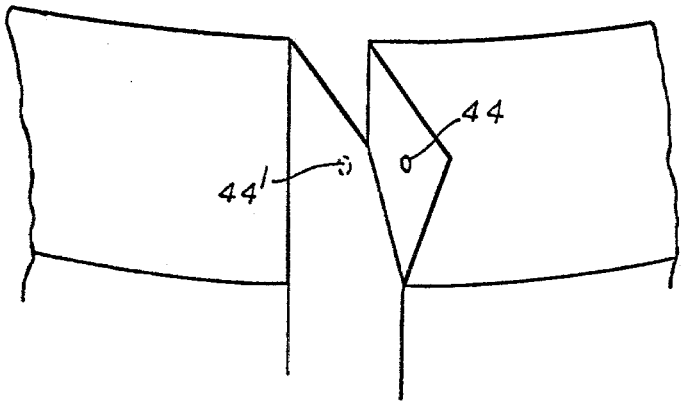
FIG. 8 illustrates a method of sealing the edges of the wrapping material.

Examples of ways of joining the edges are by the use of contact or hot melt adhesive, by precision puncturing of a point in the wrapping material within the seal area which allows the coating on its inside, (normally for heat-sealing to itself), to exude in the reverse direction and be available for heat-sealing the edges as shown by pin holes 44 and 44' in FIG. 6.

What is claimed is:

1. A continuous form-fill seal process for forming a package of a stack of nesting cups, some cups of which contain beverage making material, which process comprises forming a tube from an upwardly moving sheet of wrapping material, transversely heat-sealing a leading portion of said tube, loading vertically upwards a stack of nesting cups, some cups containing beverage making material, into the open end of said tube by means of a ram or like lifting device, flattening said tube below the lifted cups, partially transversely, heat-sealing the flattened tube below the cups to secure the stack of cups within the tube and to provide the tube with a remaining transverse open portion, removing the ram or like lifting device from the tube through the remaining open portion thereof, and thereafter transversely heat-sealing said open portion of said tube to form a hermetically sealed package.

2. A process as claimed in claim 1 in which the loading of the stack of cups is such that the top cup in the stack reaches the extreme of the tube, and the flattening of the tube tightens the stack.

3. A process as claimed in claim 1 in which the cups are non-interlocking vending cups and the stack is tightened, after the tube has been heat-sealed, to prevent seepage of the beverage making material from the cups.

4. A process as claimed in claim 1 in which the stack is provided with a lowermost cup which does not contain any beverage making material.

5. A package as claimed in claim 1 in which the top cup of the stack has a plug or snap-on lid.

* * * * *